United States Patent [19]

Wilcock

[11] Patent Number: 4,491,234

[45] Date of Patent: Jan. 1, 1985

[54] BUCKET APPARATUS

[75] Inventor: Hal J. Wilcock, Powell, Wyo.

[73] Assignee: Wayne G. Jones, Powell, Wyo. ; a part interest

[21] Appl. No.: 483,577

[22] Filed: Apr. 11, 1983

[51] Int. Cl.[3] ..... B65D 25/40

[52] U.S. Cl. ..... 220/90; 15/114; 206/361; 222/465 R; 401/121

[58] Field of Search ..... 220/90, 72, 85 H; 206/361-362.1, 15.2; 15/114; 401/121; 222/572, 465 R

[56] References Cited

U.S. PATENT DOCUMENTS

| | | | |
|---|---|---|---|
| 323,894 | 8/1885 | Whitten | 222/572 X |
| 949,644 | 2/1910 | Borgmeyer | 401/121 X |
| 1,293,951 | 2/1919 | Shevalier | 220/85 H X |
| 1,426,622 | 8/1922 | Ward | 220/90 X |
| 1,851,521 | 3/1932 | Olsen | 206/361 |
| 3,581,904 | 6/1971 | Selby | 220/90 X |
| 3,620,403 | 11/1971 | Rump | 229/22 X |
| 3,829,926 | 8/1974 | Salladay | 222/572 X |
| 4,363,433 | 12/1982 | Jaques | 206/362 X |

FOREIGN PATENT DOCUMENTS

| | | | |
|---|---|---|---|
| 218509 | 7/1924 | United Kingdom | 222/572 |

*Primary Examiner*—Stephen Marcus

*Assistant Examiner*—Robert Petrik

*Attorney, Agent, or Firm*—Arthur L. Urban

[57] ABSTRACT

Bucket apparatus including a container portion, a spout portion, a handle portion and a brush holding portion; the container portion including a bottom section and a plurality of vertical sidewall sections, the bottom section including a raised center sloping downwardly to the edges thereof; the spout portion being formed by the intersection of the upper free edges of two adjacent sidewall sections; the handle portion including gripping mechanism disposed on the outside of the container portion opposite to the spout portion, the gripping mechanism extending from a point on the outer surface of the container portion adjacent the open upper end thereof to a point on the outer surface adjacent the bottom section thereof; the brush holding portion including at least one pocket member extending inwardly from one of the sidewall sections adjacent to the handle portion, the pocket member including spaced vertical end sections extending inwardly from the sidewall section, each of the end sections having a generally inverted triangular configuration with a point extending downwardly, a front section connecting the end sections, the front section including a plurality of openings therein; whereby a brush can be inserted into the pocket member when it is not in use.

7 Claims, 4 Drawing Figures

BUCKET APPARATUS

This invention relates to a novel bucket apparatus and more particularly relates to a new bucket apparatus which facilitates the handling of brushes.

A variety of different containers have been employed to hold paint and similar materials through the years. These containers can be the original cans in which the paint is purchased or discarded containers from other materials.

Even today, many individuals simply open a can of paint, set the lid aside, stir it if required and begin painting. A brush is dipped into the paint, drawn across the edge to remove excess paint and then used on the surface to be painted. When the brush becomes dry, it is dipped into the paint, the excess removed and the paint applied to the surface again. This sequence is repeated until the task is completed.

While this procedure can be employed relatively successfully in some situations, in other cases serious problems may arise. A high degree of care must be exercised to avoid spilling paint over the edge of the full container. Also, the configuration of the rim does not lend itself to removing excess paint from the brush uniformly and easily without spilling paint over the edge of the container.

Another difficulty encountered when using the original container is how to handle the brush if the painting operation is interrupted temporarily. The telephone may ring or the painter may wish to eat a snack or attend to some other matter. If the painting must be interrupted for a few minutes, most individuals simply rest the brush on the rim of the container. Although this action keeps the brush out of the paint, it is not without its own problems. Some paint may drip off the brush onto surfaces outside the rim. Also, the brush may dry out if the interruption is extended for some reason that was not anticipated.

In order to avoid these difficulties, the painter may simply place the brush into the container and lean it against the rim. This avoids dripping paint outside the container. Also, it keeps the brush from drying out. However, the bristles will become distorted from resting against the bottom of the container. In addition, the brush may absorb excess paint which cannot be removed and may cause increased dripping during subsequent painting.

A painter may adopt some makeshift solution to the problem of how to store a brush temporarily when the painting operation is interrupted. Some persons may wrap the brush in metal foil or plastic. This keeps the dripping confined and does not distort the brush bristles. However, considerable care is required to avoid spilling the paint collected in the foil during the wrapping and removal of the brush.

A different solution may involve the drilling of a hole in the brush handle and the placement of a rigid rod therethrough. Then, the brush is suspended in the container with the rod extending across the rim to keep the brush off the bottom of the container. This arrangement can be successful under certain conditions, but still it requires special preparation and ingenuity that many people may lack.

Another situation commonly encountered while painting is the need to change brushes. For example, it may be necessary to switch from a small trim brush to a larger brush for the main acreas.

From the above discussion, it is clear that previous and past procedures for handling brushes while painting can be less than successful under a significant number of situations. Therefore, there is a need for new and improved procedures and apparatus for handling brushes while painting.

The present invention provides a novel bucket apparatus that overcomes the problems encountered with previous and present paint buckets. The bucket apparatus of the present invention provides a simple and convenient means for storing a brush during interruptions of the painting operation. The brush is maintained in the paint and so does not dry out. In addition, the brush is kept off the bottom of the container and thus the bristles are not distorted.

Furthermore, the bucket apparatus permits a selection of the position of the brush as the level of the paint changes in the container. Moreover, the bucket apparatus can be used to drain paint from a brush when required. Also, the bucket apparatus allows excess paint to be removed from the brush uniformly and easily. The bucket apparatus can be used for the cleaning of brushes if desired.

The bucket apparatus can be held conveniently without getting paint on a hand or interfering with dipping of the brush into the paint. Thus, the bucket apparatus allows a painter to concentrate on the painting task rather than shifting his attention repeatedly to the dipping of his brush into the paint. This enables the painter to be less tense about dripping or spilling paint.

The bucket apparatus of the present invention is simple in design and can be produced relatively inexpensively. The bucket apparatus can be fabricated from commercially available materials using conventional bucket forming techniques and procedures with semi-skilled labor.

The bucket apparatus can be used by persons of all ages, and particularly by those with limited dexterity. Only a minimum of instruction is required for a person to use the bucket apparatus routinely and efficiently. The apparatus is durable in construction and has a long useful life without maintenance.

These and other advantages and benefits of the novel bucket apparatus of the present invention will be apparent from the following description and the accompanying drawings in which.

Figure 1:
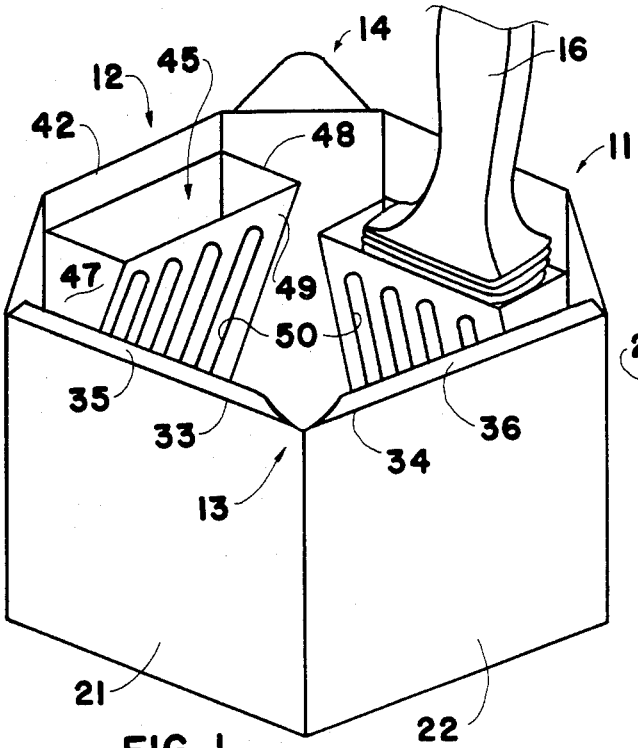
FIG. 1 is a view in perspective of one form of the bucket apparatus of the invention with brushes held therein.
Figure 2:
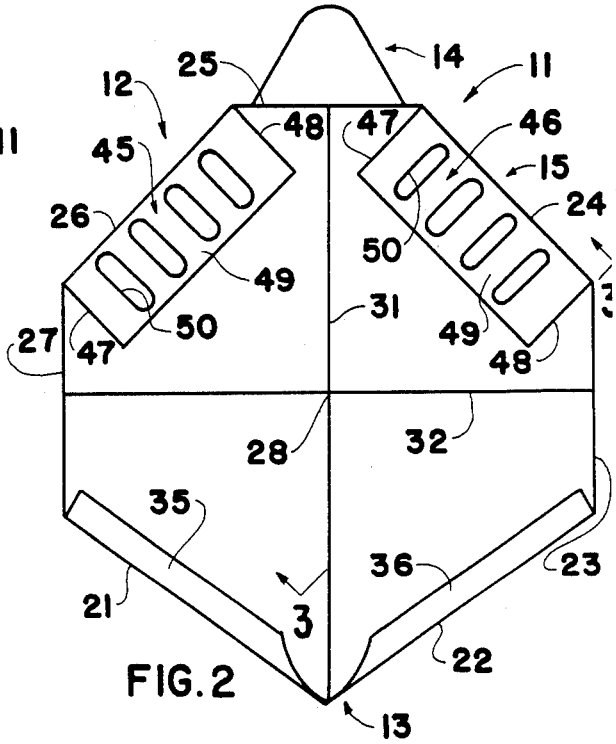
FIGS. 2 is a top view of the bucket apparatus shown in FIG. 1.
Figure 3:
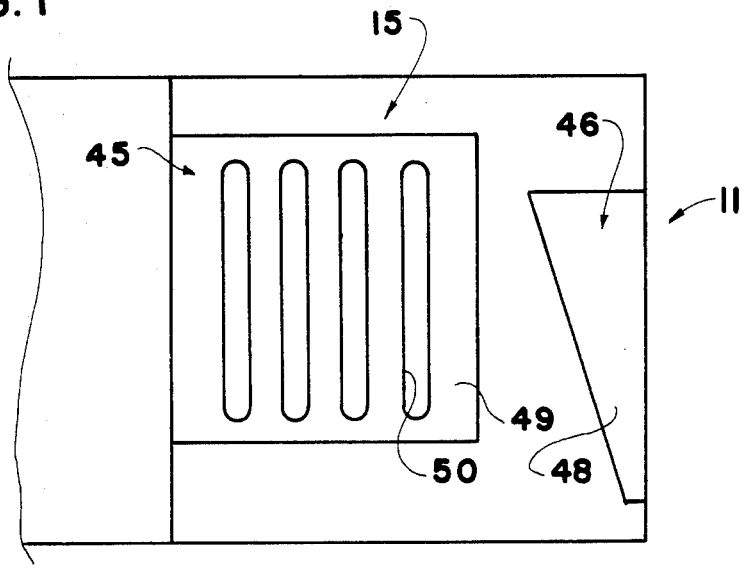
FIG. 3 is a sectional view of the bucket apparatus shown in FIG. 2 taken along line 3—3 thereof.
Figure 4:
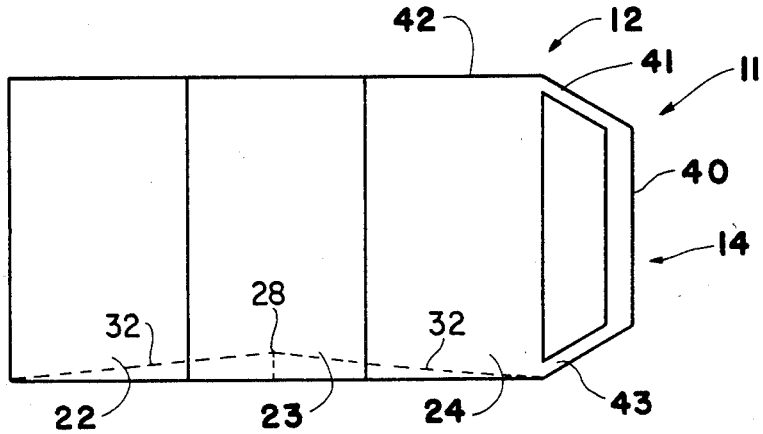
FIG. 4 is a side view of the bucket apparatus shown in FIG. 1.

As shown in the drawings, one form of the novel bucket apparatus 11 of the present invention includes a container portion 12, a spout portion 13, a handle portion 14 and a brush holding portion 15. Brush 16 is held in place within the brush holding portion 15 of the bucket apparatus 11.

The container portion 12 of the bucket apparatus 11 of the invention includes a bottom section 20 and a plurality of vertical sidewall sections 21, 22, 23, 24, 25, 26 and 27. The container portion 12 advantageously has a width greater than its height. Preferably, the container portion 12 includes an odd number of sidewall sections 21–27 and most preferably includes seven sidewall sections.

The bottom section 20 of the container portion 12 includes a raised center 28 that slopes downwardly to the edges of the bottom section. The bottom section 20 advantageously includes crossed ridge sections 31 and 32 that extend from one side of the bottom section to the other to achieve a raised center configuration.

The spout portion 13 is formed by the intersection of the upper free edges 33 and 34 of two adjacent sidewall sections 21 and 22. These sidewall sections 21 and 22 that are adjacent to the spout portion 13 preferably include inwardly extending flange sections 35 and 36 along the free upper edges 33 and 34 respectively.

The handle portion 14 of the bucket apparatus 11 includes gripping means 40. The gripping means 40 is disposed on the outside of the container portion 12. The gripping means 40 is disposed opposite to the spout portion 13 as shown. The gripping means 40 extends from a point 41 on the outer surface of the container portion that is adjacent the open upper end 42 thereof. The gripping means extends to a point 43 that is adjacent the bottom section 20 of the container portion. Advantageously, the gripping means 40 forms a loop with an open space for the fingers of the person using the bucket apparatus.

The brush holding portion 15 of the bucket apparatus 11 of the invention includes at least one and preferably two pocket members 45 and 46. The pocket members 45 and 46 extend inwardly from the sidewall sections 24 and 26 adjacent the handle portion 14.

The pocket members each include spaced vertical end sections 47 and 48. Each end section 47 and 48 has a generally inverted triangular configuration as shown with a point extending downwardly toward the bottom section 20 of the apparatus 11.

The pocket members 45 and 46 also each include a front section 49. The front section 49 connects the end sections 47 and 48. The front section 49 includes a plurality of openings 50.

The pocket members 45 and 46 advantageously have a height which is a major portion of the sidewall section height. The pocket members may be of a size to accommodate more than one brush if desired. Preferably, as shown, the pocket members are spaced at different distances from the open upper end 42 of the container portion 12.

The bucket apparatus 11 of the present invention may be formed from a variety of materials including metals, plastics and similar materials. Also, combinations of different materials may be utilized in its fabrication. Advantageously, the bucket apparatus 11 is formed as a unitary structure. Preferably, the apparatus is molded of a plastic material and most preferably with the various portions integrally molded as a single unit.

In the use of the bucket apparatus 11 of the invention, the container portion 12 is filled to a desired level with a liquid paint. The bucket apparatus may be used by grasping the handle portion 14 and carrying it to the area being painted.

A brush 16 held in the other hand is dipped into the paint in the container portion and the excess paint removed by drawing the bristles of the brush over one of the flange sections 35 or 36. The brush then is used to apply paint to a surface in the conventional manner by repeated dipping of the brush 16 into the container portion. Since the bucket 11 is held by a handle 14 outside the container portion, there is no interference from the handle and hand as with a conventional bail bucket.

If the brush is to be set aside because of an interruption or to use another size or type brush, the brush is inserted into one of the pocket members 45 or 46. The particular pocket member selected will depend upon the level of the paint in the container portion. Generally, the pocket member will be selected to maintain the brush bristles predominately below the level of the paint without allowing paint to reach too high on the brush.

When it is desired to resume the use of the brush, the brush is removed from the pocket member and is ready for use again. The bristles have not hardened or dried out. Also, the bristles are in a normal configuration for use without distortion. As the level of the paint in the container 12 drops, the brush can be stored in the lower level pocket member 46 to insure that the bristles will be in the paint.

Conversely, if it is desired to drain paint from the brush, the brush can be inserted into a pocket member that is above the level of the paint in the container. This allows the paint to drain from the bristles without distorting the bristles and without the necessity for using a separate container to achieve the desired result.

After the painting task has been completed, it may be desired to clean the brushes. This can be accomplished with the bucket apparatus for the invention by dumping any paint remaining in the container portion and replacing it with a paint solvent. Again, the brush is inserted into the pocket member 45 or 46 so that the bristles thereof are below the level of the solvent. In this way, the brush can be soaked in the solvent while controlling the level of liquid on the bristles and without distorting the bristle configuration.

The above description and the accompanying drawings show that the present invention provides a novel bucket apparatus with advantages and benefits not found in other buckets. The bucket apparatus simplifies brush care and minimizes dripping problems ordinarily encountered with conventional buckets. In addition, the bucket apparatus of the invention makes painting more convenient and less frustrating.

The bucket apparatus of the present invention is relatively inexpensive and has a long useful life. It can be used both for painting and for brush cleaning. The apparatus facilitates using the last paint remaining in the bucket.

It will be apparent that various modifications can be made in the particular bucket apparatus described in detail above and shown in the drawings within the scope of the invention. The size, configuration and arrangement of components can be changed to meet specific requirements. Additional pocket members can be included. The pocket members may be separate elements if desired.

Also, the spout and handle portions can be different. The flange sections may be located along the upper edges of other sidewall sections or even on the pocket members. Further, a bail handle may be added as a supplement to the gripping means along the outer surface of the container portion. These and other changes can be made in the bucket apparatus provided the functioning and operation thereof are not adversely affected. Therefore, the scope of the invention is to be limited only by the following claims.

What is claimed is:

1. Bucket apparatus molded of a plastic material including a container portion, a spout portion, a handle portion and a brush holding portion; said container portion including a bottom section and a plurality of vertical sidewall sections, said container portion including seven sidewall sections, said bottom section including a raised center sloping downwardly to the edges thereof; said spout portion being formed by the intersection of the upper free edges of two adjacent sidewall sections; said handle portion including gripping means disposed on the outside of one of said sidewall sections of said container portion opposite to said spout portion, said gripping means extending from a point on the outer surface of said container portion adjacent the open upper end thereof to a point on the outer surface adjacent the bottom section thereof; said brush holding portion including at least two pocket members extending inwardly from said sidewall sections adjacent to said handle portion and spaced above said bottom section, each pocket member including spaced vertical end sections extending inwardly from said sidewall section, each of said end sections having a generally inverted triangular configuration with a point extending downwardly, a front section connecting said end sections, said front section including a plurality of openings therein; whereby a brush can be inserted into said pocket member when it is not in use.

2. Bucket apparatus according to claim 1 wherein said two pocket members are spaced different distances from the open upper end of said container portion.

3. Bucket apparatus according to claim 1 wherein said pocket member has a height which is a major portion of said sidewall section height.

4. Bucket apparatus according to claim 1 wherein said sidewall sections adjacent to said spout portion include inwardly extending flange sections along the free upper edges thereof.

5. Bucket apparatus according to claim 1 wherein said bottom section includes crossed ridge sections extending from one side of said bottom section to the other.

6. Bucket apparatus according to claim 1 wherein said container portion has a width greater than its height.

7. Bucket apparatus according to claim 1 wherein said bucket apparatus is a unitary structure.

* * * * *